United States Patent [19]

Chernega

[11] Patent Number: 4,577,886

[45] Date of Patent: Mar. 25, 1986

[54] ADJUSTABLE FLEX SKI

[76] Inventor: John O. Chernega, P.O. Box 1094, Taos, N. Mex. 87571

[21] Appl. No.: 634,554

[22] Filed: Jul. 26, 1984

[51] Int. Cl.[4] ..... A63C 5/07

[52] U.S. Cl. ..... 280/602

[58] Field of Search ..... 280/602

[56] References Cited

U.S. PATENT DOCUMENTS

| | | | |
|---|---|---|---|
| 2,258,046 | 5/1940 | Clement | 280/602 |
| 2,795,431 | 8/1955 | Metcalfe | 280/602 |
| 2,918,293 | 10/1957 | Taui | 280/602 |
| 3,260,532 | 7/1966 | Heuvel | 280/602 |
| 3,300,226 | 1/1967 | Reed | 280/602 |
| 3,318,369 | 5/1965 | Ross | 280/602 |
| 3,398,968 | 8/1968 | Mutzhas | 280/602 |
| 3,537,717 | 11/1970 | Caldwell | 280/602 |
| 3,549,162 | 12/1970 | Coutts | 280/602 |
| 3,747,947 | 7/1973 | Gunzel | 280/602 |
| 3,776,563 | 12/1973 | Tigert | 280/602 |
| 4,071,264 | 1/1978 | Legrand | 280/602 |
| 4,199,169 | 4/1980 | Guenzel | 280/602 |
| 4,221,400 | 9/1980 | Powers | 280/602 |

FOREIGN PATENT DOCUMENTS

| | | | |
|---|---|---|---|
| 247763 | 10/1965 | Fed. Rep. of Germany | 280/602 |
| 3204689 | 8/1983 | Fed. Rep. of Germany | 280/602 |

*Primary Examiner*—Joseph F. Peters, Jr.
*Assistant Examiner*—J. McCarthy
*Attorney, Agent, or Firm*—William A. Eklund

[57] ABSTRACT

An adjustable flex alpine ski is disclosed. The ski includes tensile members embedded below the neutral plane in the center, shovel and tail sections of the ski. The tensile members are each fixed at one end and are independently adjustable by means of tension adjustment mechanisms located at the free ends of the members. The tension adjustment mechanisms are controlled by means of flexible shafts which terminate at hex nuts opening flushly onto the sidewalls of the ski, so as to be unobtrusive and aerodynamic, yet readily accessible in the field.

4 Claims, 6 Drawing Figures

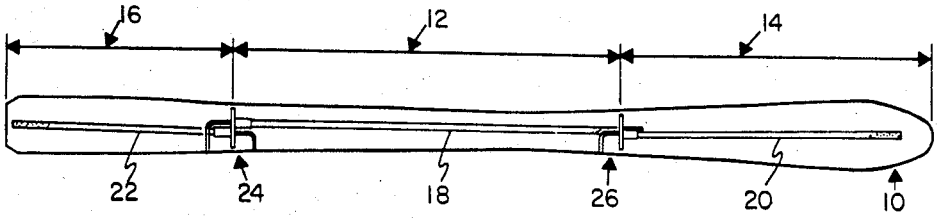
FIG. 1.
FIG. 2.
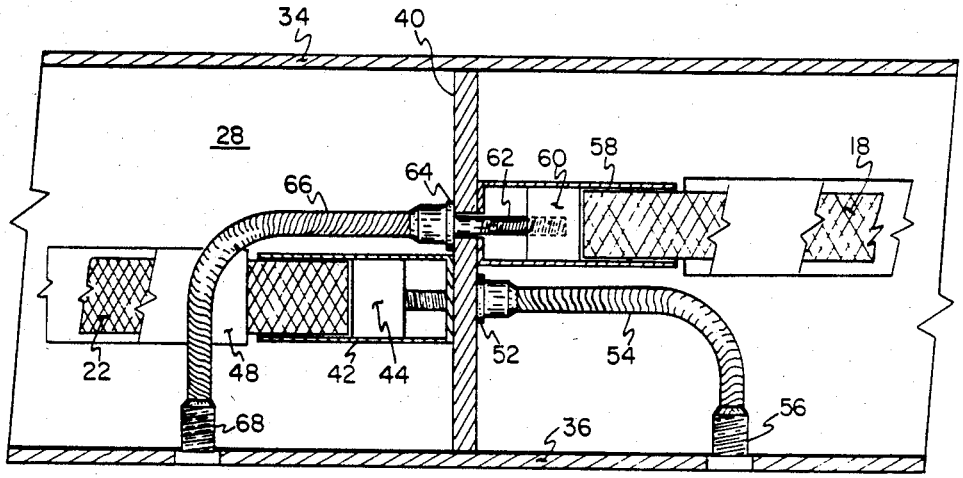
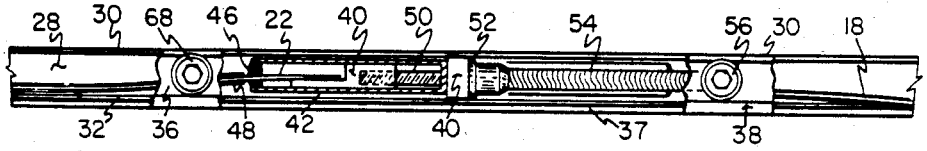
FIG. 3.

ADJUSTABLE FLEX SKI

BACKGROUND OF THE INVENTION

The invention disclosed herein is generally related to alpine, or downhill, skis. More particularly, this invention is related to alpine skis having means for varying the flexibility, or stiffness, of the ski.

The performance characteristics of modern alpine skis are well known to depend heavily on the stiffness, or flexibility, of the ski with respect to bending in the vertical plane. Moreover, such characteristics are known to depend on the flexibility along different longitudinal sections of the ski. In this regard, the alpine ski is generally described as being divided into three longitudinal sections, known as the shovel, or front section, the center section, and the tail, or rear section. Skis are fabricated with varying degrees of stiffness along these sections to meet particular requirements. For example, slalom skis are usually fabricated with shovel and tail sections which are relatively stiff, as a ski with firm end sections can be turned more quickly than a ski with soft end sections. Giant slalom skis, for which smooth tracking at high speeds is a desirable characteristic, generally have softer end sections. Mogul skis are designed to be turned quickly but must also be sufficiently flexible to absorb shocks comfortably, and are accordingly designed with a relatively soft flex. Powder skis are more flexible throughout, and are often designed as very soft giant slalom skis.

The distribution of the ski flexibility along the length of the ski is referred to as the flex pattern of the ski. It is known that relatively small changes in the flex pattern can have marked effects on the overall ski performance. The flex pattern is ordinarily determined using a standardized analytical stiffness test, in which the deflection of the ski in response to a predetermined force is measured while the ski is mounted on two support points spaced approximately 30 centimeters apart. The test is conducted, for example, at five-centimeter intervals along the length of the ski. The resulting measurements can be plotted graphically as a function of position along the ski, so that the overall flex pattern can be readily visualized and correlated with ski performance.

Corrections or alterations to the flex pattern of a ski are normally made by changing the thickness of the ski at various points, or by altering the modulus or thickness of the load-bearing surface elements of the ski.

It has been previously known to employ tensioning devices in alpine skis to selectively control the overall flexibility of the ski. However, the previously known devices are ineffective to allow selective adjustment of the flexibility along different sections of the ski. Also, various of the previously known devices have been impractical to adjust in the field, or have included adjustment mechanisms which are undesirable in that they protrude in an unwieldy manner above the surface of the ski.

SUMMARY OF THE INVENTION

Accordingly, it is the object and purpose of the present invention to provide an adjustable flex ski wherein the flexibility of different segments of the ski can be independently adjusted.

It is also an object of the invention to provide such a ski wherein the flexibility may be readily adjusted in the field.

It is another object to provide an adjustable flex ski wherein the adjustment means is unobtrusive and does not protrude above the surface of the ski.

The foregoing and other objects are attained in the adjustable flex ski of the present invention, which comprises a ski body including a foam core, upper and lower load-bearing surfaces, sidewalls, and a neutral plane. The ski further comprises a set of three elongate tensile members which are located in the center, shovel and tail sections of the ski, respectively. The tensile members are located beneath the neutral plane of the ski, being generally positioned at the interface between the foam core and the lower load-bearing surface. The tensile members are affixed to the ski at their opposite ends and are slidable within the ski along the majority of their length. The tension in each tensile member is adjustable by means of a tensioning mechanism connected to the member, such that the tension in the several sections can be independently adjusted to vary the flex pattern of the ski. In the preferred embodiment the tensile members comprise stainless steel strips positioned in the shovel, tail and center sections of the ski.

In accordance with another aspect of the invention, the tensile members are independently adjustable by means of adjustment mechanisms which include hollow elongate housing embedded in the foam core of the ski. The housings contain slidable anchors which are attached to the free ends of the tensile members. The anchors are selectively positioned in the housing by means of a threaded shaft engaged in the anchor, and a flexible shaft which extends through a right angle to open onto the sidewall of the ski. The flexible shaft preferably terminates in a hex nut which is flush with the sidewall surface, providing an unobtrusive and aerodynamic adjustment mechanism which is readily accessible in the field.

BRIEF DESCRIPTION OF THE DRAWINGS

The accompanying drawings are incorporated in and form a part of the specification. The drawings illustrate the preferred embodiment of the invention and the best mode contemplated by the inventor. The drawings, taken with the following description, serve to explain the principles of the invention. In the drawings:

FIG. 1 is a plan view in cross section of an alpine ski having the adjustable flex tensioning mechanism of the present invention;

FIG. 2 is an enlarged plan view in cross section of the rear tension assembly;

FIG. 3 is a side view in partial cross section of the assembly shown in FIG. 2;

DETAILED DESCRIPTION OF THE INVENTION

Figure 4:
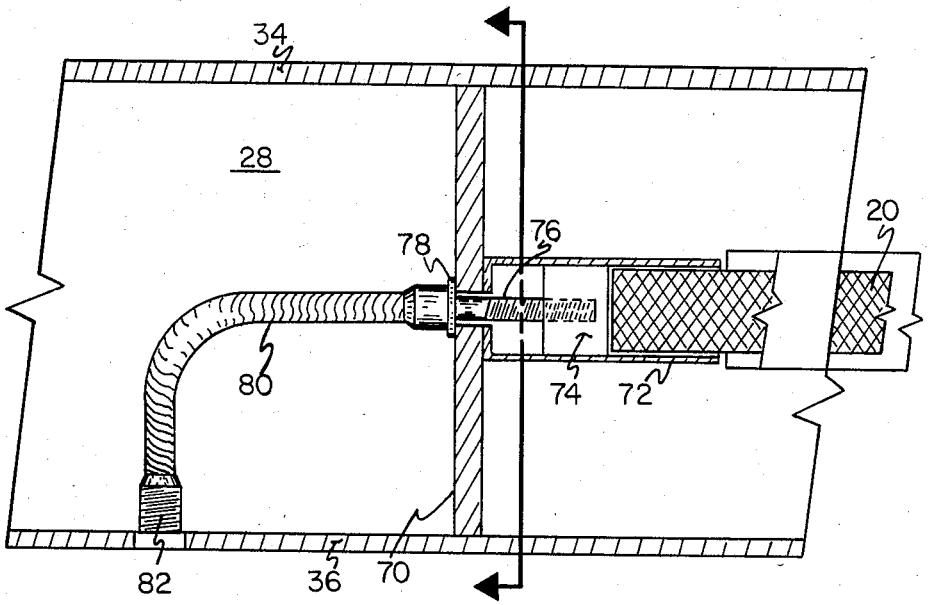
FIG. 4 is a plan view in cross section of the forward tension assembly.

Referring first to FIG. 1, the preferred embodiment of the tensioning mechanism of the invention is illustrated as it is installed in a foam core alpine ski 10 which is divided, in accordance with standard industry designation and for the purposes of illustration and the following description, into a center section 12, a shovel section 14 and a tail section 16. The three sections of the ski include stainless steel strips 18, 20 and 22, respectively. Briefly, the tension in the three strips is selectively adjustable by means of a rear tension assembly 24 located at the boundary of the middle section and the tail section, and a forward tensioning assembly 26, which is located at the boundary between the middle section and the shovel section. The strips 18, 20 and 22 are all located below the neutral plane of the ski, which is the plane which is free of tensile or compressive stresses during flexing of the ski.

As shown best in FIGS. 2 and 3, the ski 10 includes generally a foam core 28, an upper load-bearing surface 30, a lower load-bearing surface 32, sidewalls 34 and 36, running surface 37 and steel edges 38. Additional elements are typically present in a modern foam core alpine ski, however such additional elements are not essential to the operation or understanding of the present invention and will therefore not be further discussed.

The rear assembly 24 is centered around a steel thrust plate 40 which is embedded in and extends the full width of the foam core 28. On the rear side of the thrust plate 40 there is a hollow rectangular fiberglass housing 42 in which there is slidably engaged a steel anchor 44. The steel anchor is step-shaped and is welded to the steel strip 22. The steel strip 22 passes through the open rear end of the housing 42 and runs along the lower load-bearing surface 32 to the rear end of the ski, where it is fastened to both the foam core 28 and the lower load-bearing surface. In the preferred embodiment the rear end of the strip 22 is provided with a number of holes, with the strip being secured by the epoxy resin ordinarily used to fasten the core 28 to the lower load-bearing surface. A rubber sealant 46 is used to seal the opening of the housing 42 around the emerging strip 22. The steel strip 22 is enclosed along most of its length by two strips of polytetrafluoroethylene tape 48.

The anchor 44 includes a threaded bore in which is engaged a threaded shaft 50. The shaft 50 passes through a hole in the forward wall of the housing 42, an aligned hole in the thrust plate 40, and a thrust washer 52. The threaded shaft 50 is connected to a flexible shaft 54, which extends through a ninety-degree angle to the side wall 36. The shaft 54 terminates at a female hex nut 56 which is recessed in the sidewall so as to be unobtrusive and aerodynamic, yet readily accessible in the field.

On the opposite side of the thrust plate 40 from the housing 42 is a second housing 58 which likewise contains a slidable anchor 60 connected to the center steel strip 18. There is also a threaded shaft 62, thrust washer 64, flexible shaft 66, and hex nut 68, all of which operate in the same manner as the corresponding elements described above to adjust the tension in the steel strip 18. The flexible shaft 66 passes over the tail section strip 22 so that the hex nuts 56 and 68 both open onto the same sidewall of the ski for ease of adjustment in the field.

Figure 5:
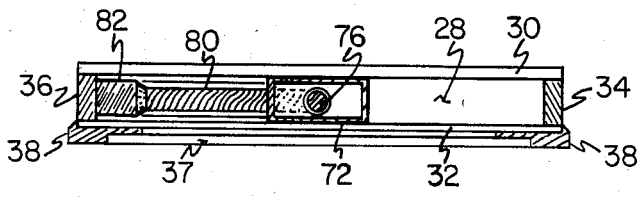
FIG. 5 is a longitudinal view in cross section of the assembly shown in FIG. 4, taken along section line 5—5 of FIG. 4.

The forward tensioning assembly 26 is shown in greater detail in FIGS. 4 and 5. The elements of the forward tensioning assembly are largely the same as those described above, however serving to adjust the tension in the steel strip 20 of the shovel section. The forward assembly includes a steel thrust plate 70, fiberglass housing 72, anchor 74, threaded shaft 76, thrust washer 78, flexible shaft 80, and female hex nut 82. The assembly operates in the same manner as described above to adjust the tension in the strip 20.

Figure 6:
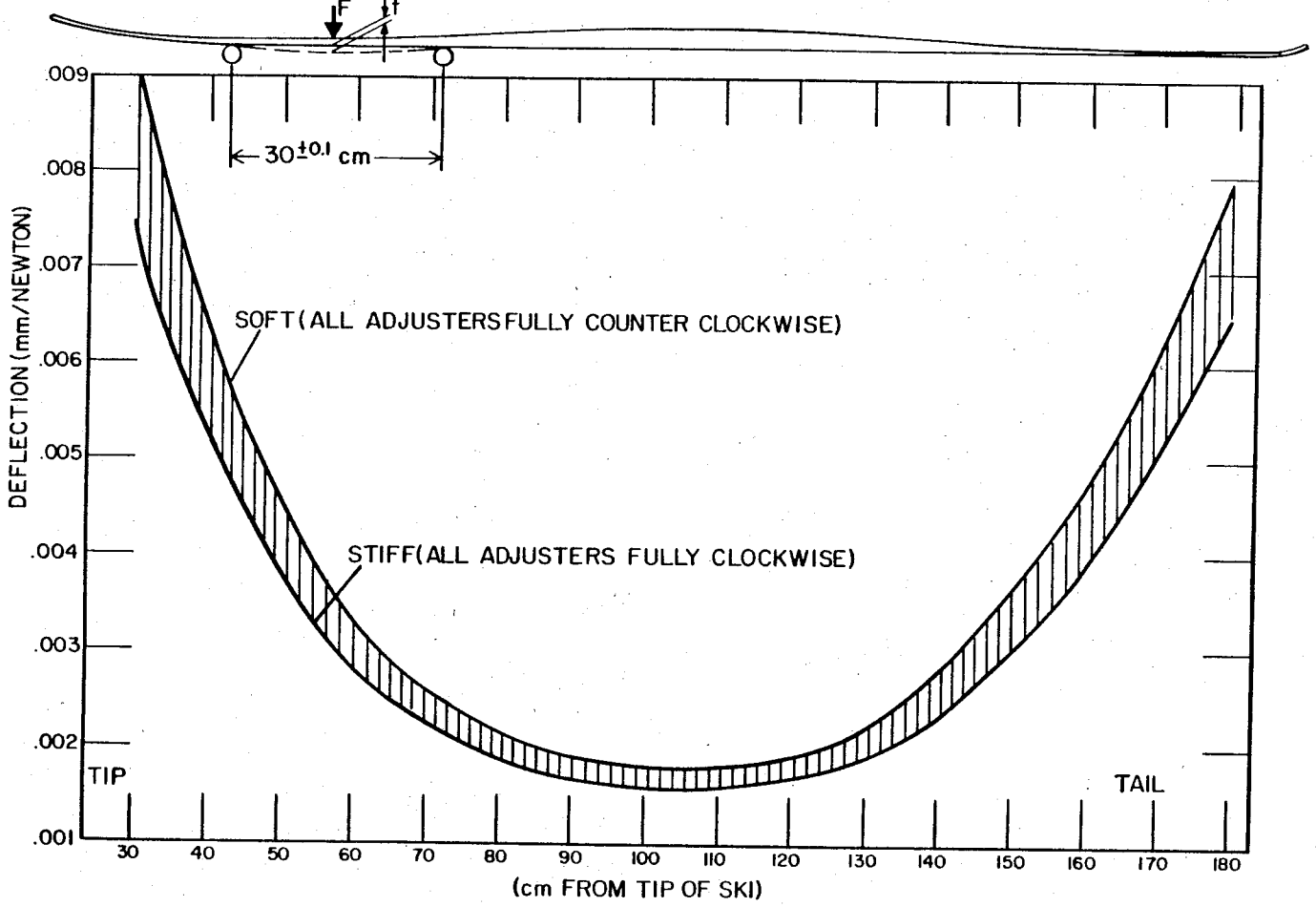
FIG. 6 is a graphical presentation of test results whcih indicate the range of flex patterns obtainable in an alpine ski provided with the present invention.

FIG. 6 is a flex distribution diagram which presents test results from an actual prototype model of the invention. In the actual determination of the flex distribution of a ski, the ski is divided into approximately fifteen zones, with the flexibility, or deflection, in each zone being measured and plotted as a function of position along the ski. The actual test procedure is described in greater detail in the book entitled The Alpine Ski, by Hermann Schultes, 1980, published by Olin Ski Co. of Middletown, Conn. In FIG. 6, deflection is measured in millimeters of deflection per Newton of force applied, with the ski being supported over a 30 centimeter span. The shaded region indicates the full range of flex distributions obtainable by varying the tension in the three steel strips. It will be understood that by appropriate adjustment of the steel strips any flex pattern falling within the shaded portion of the graph may be obtained.

Although the present invention is described and illustrated herein with respect to preferred embodiment, it will be recognized that various alterations, substitutions and modifications may be made without departing from the essential invention. Accordingly, the scope of the invention is defined by the following claims.

What is claimed is:

1. An adjustable flex ski comprising:

a ski body including a foam core, upper and lower load-bearing surfaces, sidewalls, and a neutral plane, and having a center section, a shovel section and a tail section; and first, second and third elongate flexible tensile members slidably embedded in said foam core below the neutral plane of the ski and located respectively in said center, shovel and tail sections of said ski, each of said tensile members having opposite ends and being affixed to the ski at said opposite ends of the member, and further comprising three tension adjustment means associated respectively with said tensile members, each of said tension adjustment means including a thrust plate embedded in said foam core, a hollow housing abutting said thrust plate, a tensile member anchor slidably engaged in said housing and affixed to one end of the respective tensile member, a threaded shaft engaged in said anchor and passing through said thrust plate for effecting longitudinal displacement of said anchor in said housing with consequent stretching or relaxation of the tensile member, and manually operable drive means opening on the exterior surface of one of said sidewalls of said ski body for effecting rotation of said threaded shaft, said tension adjustment means being operable to selectively vary the tension in the tensile members, whereby the flex pattern of the ski as determined by the levels of tension in said tensile members may be selectively varied by adjustment of said tension members.

2. The adjustable flex ski defined in claim 1 wherein each of said tensile members comprises a steel strip positioned at the interface between said foam core and said lower load-bearing surface of the ski body.

3. The adjustable flex ski defined in claim 1 wherein each of said manually operable drive means comprises a flexible shaft affixed to the respective threaded shaft, and wherein said flexible shaft extends through an angle of approximately ninety degrees so as to open onto the sidewall of the ski.

4. The adjustable flex ski defined in claim 3 wherein said hollow housings associated with the tension adjustment means of said first and third tensile members abut on opposite sides of a common thrust plate, whereby the flexible shafts of said first and third tensile members open onto the sidewall of the ski in proximity to one another at a location near the boundary of the center and tail sections of the ski.

* * * * *